US011104407B2

(12) United States Patent
Ginesin et al.

(10) Patent No.: US 11,104,407 B2
(45) Date of Patent: Aug. 31, 2021

(54) SCREW PROPELLER OF A POD DRIVE OF A VESSEL AND POD DRIVE COMPRISING SAID SCREW PROPELLER

(71) Applicant: AETC SAPPHIRE, Saint Petersburg (RU)

(72) Inventors: Leonid Ginesin, Moscow (RU); Sergey Gavrilov, Saint-Petersburg (RU); Leonid Kniazev, Saint-Petersburg (RU)

(73) Assignee: AETC SAPPHIRE, Saint Petersburg (RU)

( * ) Notice: Subject to any disclaimer, the term of this patent is extended or adjusted under 35 U.S.C. 154(b) by 0 days.

(21) Appl. No.: 16/812,217

(22) Filed: Mar. 6, 2020

(65) Prior Publication Data

US 2020/0307751 A1 Oct. 1, 2020

(30) Foreign Application Priority Data

Apr. 1, 2019 (RU) ..... 2708696

(51) Int. Cl.
*B63H 1/20* (2006.01)
*B63H 5/125* (2006.01)

(52) U.S. Cl.
CPC ..... *B63H 5/125* (2013.01); *B63H 2005/1254* (2013.01)

(58) Field of Classification Search
CPC ..... B63H 1/20
See application file for complete search history.

(56) References Cited

U.S. PATENT DOCUMENTS 9,926,059 B2 * 3/2018 Kokkila ..... B63H 21/17
2010/0189563 A1 * 7/2010 Gonz Lez Abal ..... B63H 1/20 416/219 R
2018/0105240 A1 * 4/2018 Kray ..... B63H 1/26

* cited by examiner

*Primary Examiner* — Andrew Polay
(74) *Attorney, Agent, or Firm* — Wood IP LLC

(57) ABSTRACT

The invention relates to the field of shipbuilding and more specifically to the screw propeller for a pod drive of a vessel, particularly an ice-going vessel, providing movement both ahead and astern in icy conditions where the ice is traversable, while also providing steering for the vessel, and to a pod drive comprising said screw propeller. To reduce the weight, and consequently the cost, of the pod drive, the screw propeller comprises a propeller hub, made so that it can be rigidly attached to the conical tailpiece of the propeller shaft, and screw propeller blades, each comprising a blade foil and a blade flange made in one piece, mounted on the propeller hub. The blade foil passes into the blade flange via a fillet joint forming the weakest portion for the possible destruction of the blade in the cross section of its foil, located immediately adjacent to the fillet joint. The outer surface of the blade flange has a profile, in its meridional cross section, curved inwards towards to the propeller axis, to reduce the distance from said blade foil cross section to the propeller axis.

5 Claims, 3 Drawing Sheets

Figure 1:
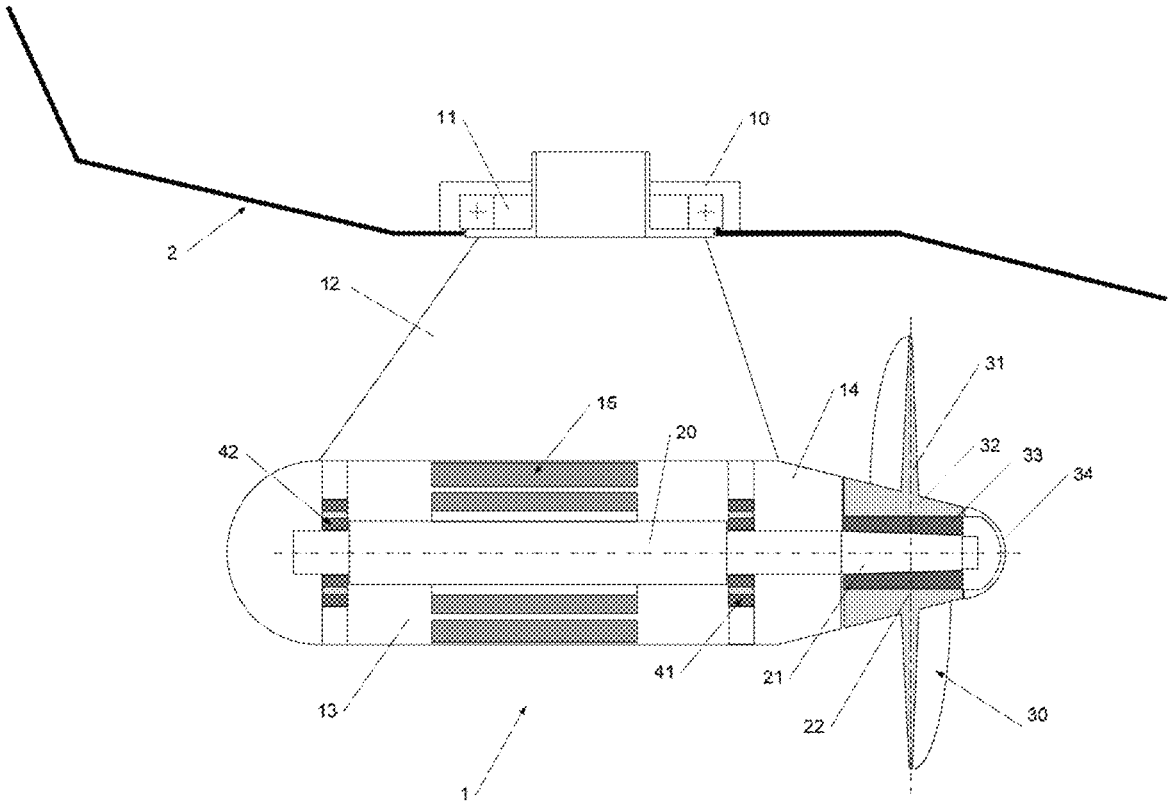

SCREW PROPELLER OF A POD DRIVE OF A VESSEL AND POD DRIVE COMPRISING SAID SCREW PROPELLER

DESCRIPTION

The present invention relates to the field of shipbuilding and more specifically to the screw propeller of a vessel, particularly an ice-going vessel, providing movement both ahead and astern in icy conditions where the ice is traversable, while also providing steering for the vessel, and to a pod drive comprising said screw propeller.

A pod drive comprises a movable part (a chamber consisting of a gondola attached to a streamlined leg) which is located outside the main hull of the vessel, and in which a propulsion engine, usually electric, is mounted on bearings. The engine shaft operates either directly or through a corresponding gear transmission to serve as a drive shaft (also known as a propeller shaft or shaft drive) for the propulsion screw propeller. A screw propeller is attached to the propeller shaft outside the chamber, usually on a conical tailpiece of the shaft, the propeller serving to convert the engine power into a flow of water which causes the vessel to move, and serving to break up large pieces of ice during movement ahead in icy conditions (in a double-acting ship). The aforementioned movable part of the pod drive is mounted on the hull of the vessel, using a swivel bearing which allows the pod drive to swivel about an axis of rotation, the orientation of which is usually close to the vertical, and which is combined with a swivel mechanism providing the necessary torsional force for swiveling the movable part of the pod drive through the required angle about the swivel axis.

One of the best-known examples of installations of the type described is a pod drive produced by the Swiss-Swedish ABB Group under the trade name Azipod. Pod drives of this type are fitted, in particular, to cruise liners (of the Oasis class, for example), icebreakers (such as the Yuri Topchev), double-acting icebreaking ships (such as the gas carrier Christophe de Margerie), and others.

When a vessel fitted with a pod drive is used in icy conditions, the movable part of the pod drive and the screw propeller are subjected to significant ice and hydrodynamic loads, which, in ordinary operating conditions, must not cause failures or breakdowns in the operation of the screw propeller itself or of the pod drive as a whole, while, if the screw propeller is subjected to extreme ice loads, any damage to the screw propeller blade must forestall any failure of the other components of the pod drive.

There is a known sea-going vessel designed for operation in icy waters, comprising a pod drive (azimuth thruster) with a screw propeller and a bush for the screw propeller (patent RF 2584038 C2, 20 May 2016). The bush is made in the form of a cutter and extends beyond the boundaries of the plane of rotation of the propeller in such a way that, if the bush strikes a block of ice, it breaks it before the rest of the screw propeller strikes said block. Thus, in this technical solution, the action of ice loads on the screw propeller is reduced when the screw propeller interacts axially with a block of ice submerged to the level of the casing or to a deeper level.

The main drawback of this solution is that it is not effective when the screw propeller interacts laterally with the ice and when the blades strike fragments of ice located outside the zone of action of the cutters of the propeller bush.

There is a known screw propeller for an ice-going vessel, which is the closest prior art to the claimed invention, comprising a propeller hub and blade flanges removably attached to the hub, on each of which flanges at least one integrally formed blade is placed, at least two integrally formed blades being positioned on at least one of the blade flanges (EP 2993120 A1, 9 Mar. 2016). Thus, the screw propeller has six blades instead of four, each individual blade being made narrower and thinner; that is to say, the maximum force required to damage one blade is reduced, while the requisite strength properties of the propeller as a whole are retained.

Drawbacks of the known screw propeller are the considerable complexity of its design, the difficulty of manufacturing the twin blades, and the increased cost of repair due to the need to replace twin blades having a common flange when only one of them is damaged. Because of these considerations, the aforementioned known screw propeller has not been included in any pod drive designs that have been implemented.

A necessary condition for ensuring the operability of the movable part of a pod drive and screw propeller is that they should be designed with allowance for what is known as the principle of "pyramidal strength", according to which any damage to the blade of a screw propeller must not result in any significant damage to other components of the pod drive or the vessel. In practice, the adoption of this principle means that all components of the design forming part of a power train, starting at the screw propeller and ending at the assembly for attaching the swiveling mechanism to the vessel's hull, must remain operable when a "blade failure load" (BFL), the maximum force causing damage to a blade, acts on the screw propeller. "Damage to a blade of a screw propeller" is taken to mean the unacceptable bending of a blade due to the plastic deformation of the material, or the breaking of the blade into separate pieces (destruction of the blade).

Damage to a blade is usually the result of its interaction with ice, and the corresponding procedure for calculating the blade failure load is governed by the regulatory texts of the Shipping Register and other classification organizations (DNV-GL, IACS).

In the design of a pod drive, the thicknesses, strength and rigidity of the components of a "pyramidal strength" power train must provide the requisite reserves of strength and minimal clearances between rotating and stationary surfaces to ensure that no damage is caused to the pod drive components when blade failure occurs, and that the pod drive operates normally after the replacement of a damaged blade. Increasing the blade failure load in the design of a pod drive will cause an unjustifiable increase in the thicknesses and rigidity of the power components and a corresponding rise in manufacturing costs for production.

The technical problem facing the present invention is that of reducing the design value of the blade failure load while meeting all the requirements of the Shipping Register for screw propeller strength.

The technical result achieved by the invention is that of reducing the weight, and consequently the cost, of the pod drive.

This technical result is achieved in that the screw propeller of a pod drive of a vessel, for fitting to a propeller shaft, comprises a propeller hub, made so that it can be rigidly attached to the conical tailpiece of the propeller shaft, and screw propeller blades, each of which comprises a blade foil and a blade flange, made in one piece, mounted on the propeller hub, the blade foil passing into the blade flange via a fillet joint forming the weakest portion for the possible destruction of the blade in the cross section of its foil located immediately adjacent to the fillet joint, the outer surface of the blade flange having, in its meridional cross section, a profile curved inwards towards the propeller axis, to reduce the distance from said blade foil cross section to the propeller axis.

It is known that the value of the blade failure load depends on the thickness of the cross section of the blade foil at the start of the fillet transition to the flange, and on the distance from said cross section to the propeller axis, as well as on the mechanical properties of the blade material.

The minimal thicknesses of the blade cross sections and the radii of the fillet joint are determined in accordance with the current rules of the Shipping Register, as is the relative radius to which the load on the propeller is applied in the calculation of the value of the blade failure load. The blades of an ice-going screw propeller are usually made from a limited range of special stainless mould steels with specific mechanical properties.

By making the outer surface of the blade flange with a profile in the meridional cross section curved inwards towards the propeller axis to reduce the distance from said blade foil cross section to the propeller axis, the moment arm of the blade failure load is increased relative to the conventional conical profile and the correspondingly shorter moment arm of said load, which, in turn, leads to a reduction of the design value of the blade failure load, while simultaneously meeting all the requirements of the Shipping Register for screw propeller strength. Thus the loads acting on other components of the pod drive in the plastic bending of, and/or damage to, the screw propeller blade are reduced, thereby enabling the weight, and consequently the cost, of the pod drive to be reduced. Specific examples of embodiment of the invention are given in the dependent claims of the invention.

In particular, the cross section of the transition from the blade foil to the flange is located at a smaller distance from the propeller axis than the distance from the point of intersection of the screw propeller shaft to a straight line located in the meridional cross section of the screw propeller and joining the extreme outer radii of the propeller blade flange, thereby providing the aforementioned reduction in the distance from the smallest cross section of the profile to the propeller axis by comparison with a conventional conical profile.

According to the invention, the propeller blade flange has a hydrodynamic profile, in its meridional cross section, formed by curved lines and/or smoothly connected conical portions, which is curved inwards towards the propeller axis, resulting in the aforementioned reduction in the distance from the transition cross section to the propeller axis.

The screw propeller is usually constructed in a composite way with removable blades, making it comparatively simple to replace an individual blade if it is damaged, while retaining the operability of all the other components of the pod drive. However, provision may also be made for all the screw propeller blades to be made in one piece with the hub, forming an integrally cast screw propeller. The aforementioned change in the shape of the blade flange for reducing the value of the blade failure load is also applicable to the change in the shape of the hub in the case of an integrally cast screw propeller.

The invention also relates to a pod drive of a vessel, comprising a pod drive gondola and the screw propeller described above, with a propeller hub casing and a spacer casing located between the screw propeller and the pod drive gondola.

Figure 2:
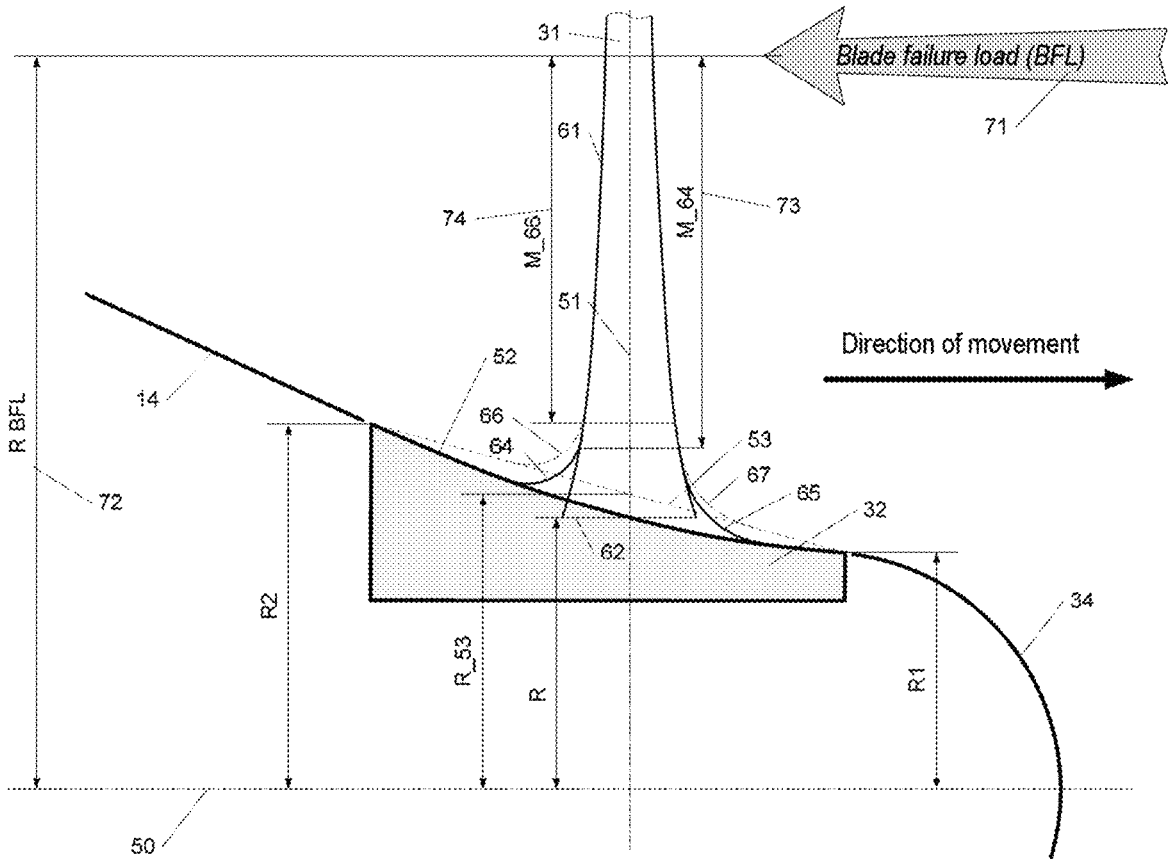
Figure 3:
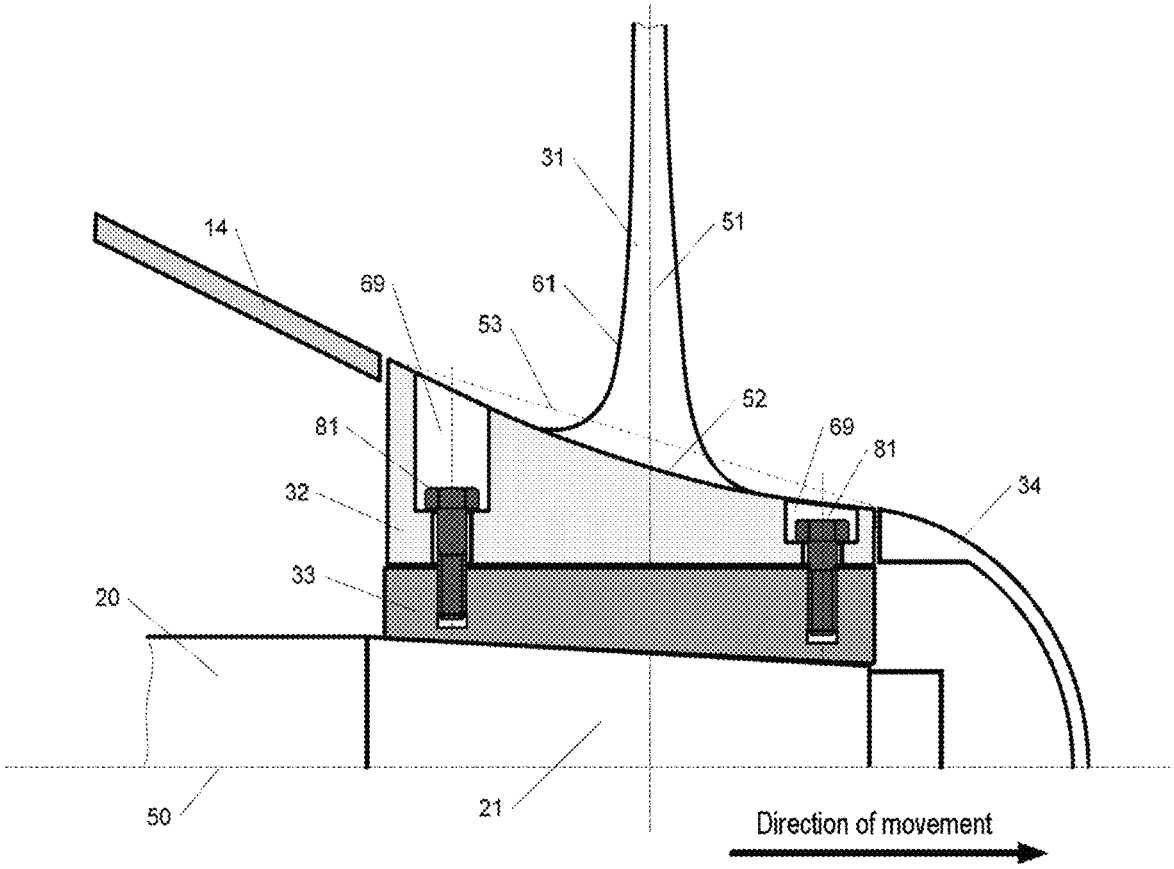

The invention is explained with the aid of drawings, showing:

in FIG. 1: a pod drive;

in FIG. 2: a meridional cross section through the bush of a screw propeller;

in FIG. 3: a cross section through a composite screw propeller.

Identical structural components in the different figures are denoted by identical references.

FIG. 1 shows a pod drive 1, attached to the hull 2 of a vessel with the aid of an attachment assembly 10 and a swivel bearing 11, the pod drive taking the form of a chamber consisting of a gondola 13 attached to a leg 12, with an electric propulsion motor 15 and a propeller shaft 20 placed inside. The propeller shaft 20 has a conical tailpiece 21, to which a driving screw propeller 22 is attached outside the gondola.

Two bearings 41, 42 are positioned on the propeller shaft 20, these bearings serving to support the shaft 20 of the electric propulsion motor 15 and to transmit the thrust (traction) from the propeller 22 to the casing of the pod drive.

The screw propeller 22 comprises a propeller hub 33, made so that it can be rigidly attached to the conical tailpiece 21 of the propeller shaft 20; screw propeller blades 30, each consisting of a blade foil 31 and a blade flange 32 made in one piece, mounted on the propeller hub 33; and a casing 34 of the screw propeller bush.

The gondola 13 of the pod drive and the screw propeller 22 are interconnected by a spacer casing 14.

FIG. 2 shows a meridional cross section through the screw propeller hub, together with a diagram of a calculation of the strength of the screw propeller as a function of the action of the blade failure load, or BFL.

The outer surface of the blade flange 32 has, in its meridional cross section, a profile curved inwards towards the axis 50 of the propeller, and denoted by the reference 52.

According to the shipbuilding and classification rules, the BFL 71 is applied at a distance 72 from the propeller axis, also called the radius, corresponding to R_BFL=0.8 R in the weakest direction of the blade failure load. The calculation of the bearing capacity of the blade is based on the action of the bending moment of the BFL 71 for the cross section 62 of the transition of the blade foil 31 into the flange 32, which is the weakest section outside the boundaries of the fillet transition of the blade foil 31 to the blade flange 32. This cross section is usually located in the contact area between the fillet 64 and the blade profile 61. The fillet, with another relatively axial line 51 of the screw propeller blade on the side of the blade profile 61, is denoted by the reference 65. The difference between the radius of application of the BFL and the radius of the location of the weakest cross section outside the fillet transition determines the moment arm 73 of the action of the BFL M_64, and, correspondingly, the value of the bending moment in the calculated cross section, which is the product of the BFL 71 and the moment arm 73 of the force M_64.

According to the standards, the blade failure load $F_{ex}$, in kN, is calculated by the formula:

$$F_{ex} = \frac{0.3\,ct^2\sigma_{ref}}{0.8D - 2r} \cdot 10^3,$$

where $$\sigma_{ref} = 0.6\sigma_{0.2} + 0.4\sigma_u,$$

where $\sigma_u$ and $\sigma_{0.2}$ are the specific maximum values of the ultimate strength and yield point of the blade material;

D, c, t, and r are, respectively, the propeller diameter, and actual length of the chord, thickness and radius of the cylindrical root section of the blade at the weakest point outside the boundaries of the fillet transition, determined by the design of the screw propeller; this section is usually located in the area of attachment of the fillet to the blade profile.

As seen in the strength calculation formula, for a chosen material and a specific shape (geometry) of the blade 30, the value of the blade failure load applied at a radius of 0.8 R is mainly determined by the radius of the location of the weakest section outside the boundary of the fillet transition of the blade foil 31 into the blade flange 32, or, in other words, by the moment arm 73 of the action of the BFL.

FIG. 2 also shows that the calculated section 62 of the transition of the blade foil 31 into the flange 32 is located at a distance R from the propeller axis 50 which is less than the distance R_53 from the point of intersection of the propeller axis 50 and a straight line 53 located in the meridional cross section of the screw propeller 22 and connecting the extreme outer radii R1, R2 of the propeller blade flange 32.

By using an inwardly curved hub profile 52, the moment arm 73 of the BFL can be increased relative to the conventional conical generatrix 53 of the hub, and therefore relative to the shorter moment arm 74. The fillets connecting the blade foil 31 to the blade flange 32 of a conical hub are denoted by the references 66 and 67. Consequently, when an inwardly curved hub shape 52 is used, the bending moment causing the destruction of the blade foil 31 reaches its maximum calculated value at a smaller value of the blade failure load 71 than when a rectilinear conical shape 53 is used.

This enables the design value of the blade failure load to be reduced, while meeting all the requirements of the Shipping Register for screw propeller strength, and thereby acting in accordance with the principle of pyramidal strength, by reducing the loads on other components of the pod drive when the screw propeller 30 is subjected to plastic bending (or damage).

FIG. 3 shows the design of a composite screw propeller of a pod drive, which is commonly used for ice-going vessels. The composite screw propeller usually consists of blades 30, each formed by a blade foil 31 and a blade flange 32. Said blades 30 are joined to the propeller hub 33 by means of bolts 81 fitted in shafts 69 in the blade flange 32, the depth of these shafts being determined by a requirement to avoid the projection of the locking components of the screw propeller blade attachment bolts 81 beyond the flange 32.

The diameter of the propeller shaft 20 and the length of the conical part 21 of the shaft are usually determined by a requirement to transmit the maximum torque from the electric propulsion motor to the propeller of the pod drive. The hub 33 is attached to the portion 21 of the shaft with an interference fit, and the thickness of the hub 33 is determined by a requirement to provide the necessary degree of interference fit and strength in the hub, including the threaded sockets for the blade attachment bolts 81.

The minimum thickness of the blade flange 32 of the screw propeller is determined by a requirement to provide sufficient material under the heads of the bolts 81 for a reliable attachment of the blade 30 to the hub 33, and a minimum depth of the shafts 69 required to achieve the condition of ensuring that the projecting locking parts of the screw propeller blade attachment bolts 81 are sunk into the blade flange 32.

When the aforementioned design constraints are met, the location of the weakest cross section, shown in FIG. 2, outside the fillet transition of the blade foil 31 into the blade flange 32 will be determined by the shape of the generatrix of the flange (bush) of the screw propeller. As seen in FIG. 2, for a given value of the radius of the leading edge of the bush R1, the use of an inwardly curved shape of the generatrix 52 enables said weakest cross section to be located at a smaller radius than in a conventional conical profile 53.

This enables the design value of the blade failure load to be reduced by comparison with the conventional shape of the blade flange of a composite screw propeller, thereby acting in accordance with the principle of pyramidal strength by reducing the loads acting on other components of the pod drive when a blade of the screw propeller 30 is damaged to values which avoid damage to the components of the pod drive during operation in icy conditions.

The invention claimed is:

1. A screw propeller for a pod drive of a vessel, for fitting on a propeller shaft, comprising a propeller hub, made so that it can be rigidly attached to the conical tailpiece of the propeller shaft, and screw propeller blades, each of which comprises a blade foil and a blade flange, made in one piece, mounted on the propeller hub, the blade foil passing into the blade flange via a fillet joint forming the weakest portion for the possible destruction of the blade in the cross section of its foil located immediately adjacent to the fillet joint, wherein the outer surface of the blade flange has, in its meridional cross section, a profile curved inwards towards the axis of the propeller, to reduce the distance from said cross section of the blade foil to the propeller axis, and wherein the cross section of the transition of the blade foil into the flange is located at a distance from the propeller axis which is less than a distance from the point of intersection of the propeller axis and a straight line located in the meridional cross section of the screw propeller and connecting two extreme outer radii of the propeller blade flange.

2. The screw propeller of claim 1, wherein the propeller blade flange in its meridional cross section has a hydrodynamic profile formed by smoothly combined conical portions.

3. The screw propeller of claim 1, wherein it is made in the form of a composite screw propeller with removable blades, attached to the hub using a disconnectable joint.

4. The screw propeller of claim 1, wherein all the blades of the screw propeller are made in one piece with the hub, forming an integrally cast screw propeller.

5. A pod drive for a vessel, comprising a pod drive gondola, a screw propeller according to claim 1, a spacer casing positioned between them, and a propeller casing.

* * * * *